US005457864A

United States Patent [19]

Sakaida

[11] Patent Number: 5,457,864

[45] Date of Patent: Oct. 17, 1995

[54] DEVICE FOR AFFIXING A TRIM COVER ASSEMBLY OVER A CUSHION MEMBER FOR AN AUTOMOTIVE SEAT

[75] Inventor: Masaharu Sakaida, Akishima, Japan

[73] Assignee: Tachi-S Co., Ltd.

[21] Appl. No.: 224,279

[22] Filed: Apr. 7, 1994

[51] Int. Cl.[6] ..... B68G 7/00

[52] U.S. Cl. ..... 29/91.5; 29/281.3; 29/448

[58] Field of Search ..... 29/91.5, 448, 281.1, 29/281.3, 281.4

[56] References Cited

U.S. PATENT DOCUMENTS

| | | | |
|---|---|---|---|
| 4,385,427 | 5/1983 | Fraiser | 29/91.5 |
| 4,608,740 | 9/1986 | Bloys et al. | 29/91.5 |
| 4,665,606 | 5/1987 | Saito et al. | 29/448 |
| 4,675,962 | 6/1987 | Tillner et al. | 29/91.5 |
| 4,786,354 | 11/1988 | Makino . | |
| 4,799,988 | 1/1989 | Shimada . | |
| 4,837,905 | 6/1989 | Sullivan et al. | 29/91.5 |
| 4,845,925 | 7/1989 | Thompson . | |
| 4,856,171 | 8/1989 | Croteau | 29/448 |
| 4,934,036 | 6/1990 | Miyamoto | 29/281.4 |
| 4,939,832 | 7/1990 | Satuka et al. | 29/281.4 |
| 4,942,651 | 7/1990 | Miyamoto | 29/91.5 |
| 5,287,610 | 2/1994 | Gomolak et al. | 29/91.5 |
| 5,345,661 | 7/1994 | Hotton et al. | 29/91.5 |

*Primary Examiner*—Irene Cuda
*Assistant Examiner*—Marc W. Butler
*Attorney, Agent, or Firm*—Oldham, Oldham, & Wilson Co.

[57] ABSTRACT

A device directed to an incomplete seat sub-assembly having a foam cushion member and a trim cover assembly fixed thereto, extending a reversely turned overhang section therefrom. The device basically includes a frame assembly including a support frame having a configuration generally equal in shape to a part of outer peripheral sides of the cushion member, on which support frame, the incomplete seat sub-assembly is turned upside down and placed, a cramp element for securing an end of the overhang section of trim cover assembly to the support frame, and a pressing element for applying a downward pressure towards the support frame, so that the cushion member is pressed and moved downwardly by the pressing element, while the overhang section is turned over relative to the support frame and cover a whole body of the cushion member. The device includes an inwardly pressing element for pressing both lateral sides of the cushion member inwardly of the frame assembly, and an outwardly stretching element for stretching the overhang section of trim cover assembly outwardly of the frame assembly, so as to permit easy downward movement of the cushion member through the support frame, thus facilitating the turning-over of the overhang section to cover the cushion member.

12 Claims, 5 Drawing Sheets

DEVICE FOR AFFIXING A TRIM COVER ASSEMBLY OVER A CUSHION MEMBER FOR AN AUTOMOTIVE SEAT

BACKGROUND OF INVENTION

1. Field of the Invention

The present invention relates to a device for affixing a trim cover assembly over a foam cushion member in order to produce an automotive seat or a vehicle seat.

2. Description of Prior Art

Generally, a vehicle or automotive seat comprises a seat cushion for receiving a passenger's buttocks and thigh portion and a seat back for receiving his or her back. Each of such two seat constituent elements is by and large composed of a foam cushion member forming a main body, a trim cover assembly affixed over the foam cushion member, and a seat frame embedded or inserted in the same cushion member. In most cases, the trim cover assembly is of a multi-layer lamination structure, as typically found in a three-layer lamination type trim cover assembly comprising a surface cover layer, a thin foam padding layer (e.g. a slab urethane foam material), and a back cloth layer.

In this sort of seat construction, the process for producing a resulting seat constituent element, namely, a seat cushion or a seat back, has been carried out, using such incomplete seat sub-assembly (SA') as shown in FIG. 9, which comprises a foam cushion member (P) and a three-layer lamination type trim cover assembly (C) fixed thereto in an overhang fashion.

The foam cushion member (P) illustrated in FIG. 9 is so formed to have a frontal surface (not clearly shown but understandable in FIG. 9) having a predetermined outer shape of a seat, an upper side wall portion (P1-a), two lateral side wall portions (P1-b)(P1'-b), a U-shaped reverse flat wall portion defining an upper reverse wall part (P2-1) and two reverse side wall parts (P2-2)(P2'-2), and lower wall portion (P3). All the inward edges of the upper and side reverse wall parts (P2-1)(P2-2)(P2'-2), thus, define a U-shaped cut-away area (P2-3). Also, the cushion member (P) has a hollow therein as can be seen from the designation (P4) in FIG. 9, which denotes an inner reverse wall, and also from FIG. 2. Though not shown, a suitable seat frame may be inserted through the cut-away area (P2-3) into the inner hollow of the cushion member (P).

The trim cover assembly (C) per se is formed from the following three layers: a surface cover layer (C1), a foam padding layer (C2) and a back cloth layer (C3) laminated in this order. But, in FIG. 9, the trim cover assembly (C) is shown as being turned upside down to expose upwardly the back cloth layer (C3), for a subsequent manual processing purpose. Normally, the trim cover assembly (C) is preformed from one unitary sheet of a three layer lamination structure, by sewing, into such a three-dimensional body as is understandable from FIG. 10, that conforms generally to a whole body of the foregoing foam cushion member (P). Such three-dimensional body of trim cover assembly (C) is turned over and fixed at its central area to the foregoing frontal surface of cushion member (P) to form what is called an "overhang" state, as can be seen in FIG. 9. This overhang form of trim cover assembly (C) comprises a central section (not seen from both FIGS. 9 and 10 but can be understood from the reverse side of the turned-over body thereof) fixed to the frontal surface of cushion member (P), an upper overhang section (C4) extending continuously from the upper side of the central section, a pair of lateral overhang sections (C5) and (C5') each extending continuously from both lateral sides of the central section, and a lower overhang section (C'). The upper overhang section (C4) is sewn, at its both sides, fixedly with the respective two lateral overhang sections (C5)(C5') as can be seen from the seam lines (SL)(SL').

A hook-like anchor member (F) is fixed at the end of the upper overhang section (C4), and two hook-like anchor members (F1)(F1) are fixed at both ends of the two lateral overhang section (C4). Those anchor members (F, F1) are adapted to be hookingly secured over a seat frame (not shown) which will be inserted in the hollow of cushion member (P).

As viewed from FIG. 9, the thus-preformed overhang form of trim cover assembly (C) exposes its back cloth layer (C3) outwardly and the central section of trim cover assembly (C) at the back cloth layer (C) is fixed to the corresponding central surface area of cushion member (P). This fixation is effected (P) through a bonding process or a foaming process. That is, in the bonding process, a worker should use a suitable adhesive to bond the central reverse-side area of trim cover assembly (C) to the corresponding central surface area of cushion member (7), with his hands, or in the foaming process, the turned-over trim cover assembly (C) is placed in a foaming mould used for forming the cushion member (P) and foamed with a foaming base material in the mould so as to integrally fix the central reverse-side area of trim cover assembly (C) to the corresponding central surface of the resultant foam cushion member (P).

Conventionally, this incomplete seat assembly (SA') with the trim cover assembly overhang sections (C4)(C5)(C5')(C') is processed manually by the worker, who forcibly turns those overhang sections (C4)(C5)(C5')(C') over towards the mating reverse wall portions (P2-1)(P2-2)(P2'2)(P3) of cushion member (P) in order to produce the resultant seat sub-assembly (SA) as in FIG. 10.

However, this manual operation has been very troublesome, imposing an extraordinary labor on a worker and further requiring a high hand force to him or her, because the expanding area or depth of the upper overhang section (C4) is naturally great to cover both upper side wall portion (P1-a) and upper reverse flat wall part (P2-1) and therefore, especially to turn over such upper overhang section (C4) up to those two portions of cushion member (P), requires a high hand force on the worker's part, leaving thus the problem that a physically weak worker with very small hand force can not turn over that upper overhang section (C4).

SUMMARY OF THE INVENTION

In view of the above-stated drawbacks, it is therefore a primary purpose of the present invention to provide a novel device for affixing an overhang section of a trim cover assembly to a cushion member automatically, in the above-mentioned incomplete seat sub-assembly.

In order to attain such purpose, the device according to the present invention, basically, comprises:

- a frame means including a support frame having a configuration generally equal in shape to a part of outer peripheral sides of the cushion member associated with the incomplete seat sub-assembly, on which support frame, the incomplete seat sub-assembly is to be turned upside down and placed;
- a cramp means for securing an end of the overhang section of the trim cover assembly to an inward side of the support frame means; and a pressing means for applying a downward pressure towards the support frame.

Accordingly, when the incomplete seat sub-assembly is turned upside down and placed on the support frame, with a reverse side of the cushion member exposed upwardly, the overhang section of trim cover assembly is secured by the cramp means to the support frame, and then operation of the pressing means applies the downward pressure against the reverse side of the cushion member, thereby causing the cushion member to be moved downwardly through the support frame, whereby the overhang section of the trim cover assembly is turned over relative to the support frame and cover the whole body of the cushion member by releasing a securing action of the cramp means, so as to transform the incomplete seat sub-assembly into a resulting seat sub-assembly with the whole body of the cushion member covered with the trim cover assembly.

In one aspect of the invention, the frame means includes an inwardly pressing means for pressing both lateral sides of the cushion member of the incomplete seat sub-assembly in a direction inwardly of the frame means and an outwardly stretching means for stretching the overhang section of the trim cover assembly in a direction outwardly of the frame means, so as to permit the cushion member to be easily moved downwardly through the support frame by operation of the pressing means, thereby facilitating the ease with which the trim cover assembly overhang section is turned over to cover the cushion member.

Preferably, the inwardly pressing means may comprise a pair of mutually opposed pressing members with their respective actuators, and the outwardly stretching means may comprise a pair of mutually opposed stretcher plates with their respective actuators and a pair of mutually opposed L-shaped stretcher rods with their respective actuators.

Preferably, the frame means may include a table member disposed below the support arm, on which table member, the resulting seat sub-assembly is placed, and a lifting means may be provided at the table means, so that the resulting seat sub-assembly may be raised by that lifting means form the table member.

In another aspect of the invention, the trim cover assembly overhang section is provided at the end thereof with an anchor member made of an elastic synthetic resin material, and the support frame includes a pair of securing means for securing the anchor member, such pair of securing means being slidable along an outer surface of the support frame in a direction toward and away from each other. Those two securing means are normally spaced apart from each other a distance generally equal to a length of the anchor member, allowing securement of the anchor member between the two securing means, and further allowing the anchor member to be pressed by the two securing means and resiliently ejected from the support frame.

Preferably, a discharging means is provided adjacent to the table member, so that the resulting seat sub-assembly may be pushed and discharged outwardly from the table member by operation of the discharging means.

Other various features and advantages will become apparent from reading of the descriptions hereinafter, with reference to the drawings.

DETAILED DESCRIPTION OF PREFERRED EMBODIMENT OF THE INVENTION

At first, it should be understood that the present invention is directed to a device applied to the conventional seat sub-assembly (SA' or SA) that has been described in the prior art description above. Therefore, hereinafter, a specific explanation thereon is omitted to avoid repetition of description, and all like designations to be given for the seat sub-assemblies (SA' or SA) in the present description correspond to all like designations given in the prior art description.

Figure 10:
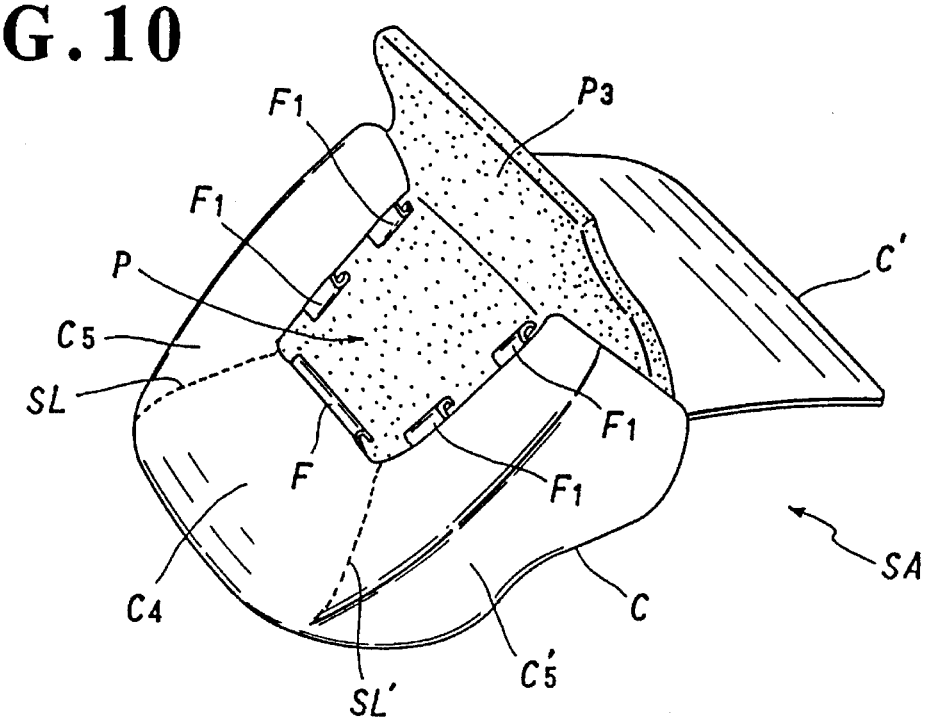
FIG. 10 is a perspective view of a resulting seat sub-assembly produced by the device.

Referring now to FIGS. 1 through 8, there is illustrated one preferred embodiment of a device, in accordance with the present invention, which automatically turns over the overhang sections (C4, C5, C5', C') of trim cover assembly (C) towards the reverse side of cushion member (P) so as to affix the trim cover assembly (C) over the whole body of cushion member (P), thereby producing such resultant seat sub-assembly (SA) as in FIG. 10.

Figure 1:
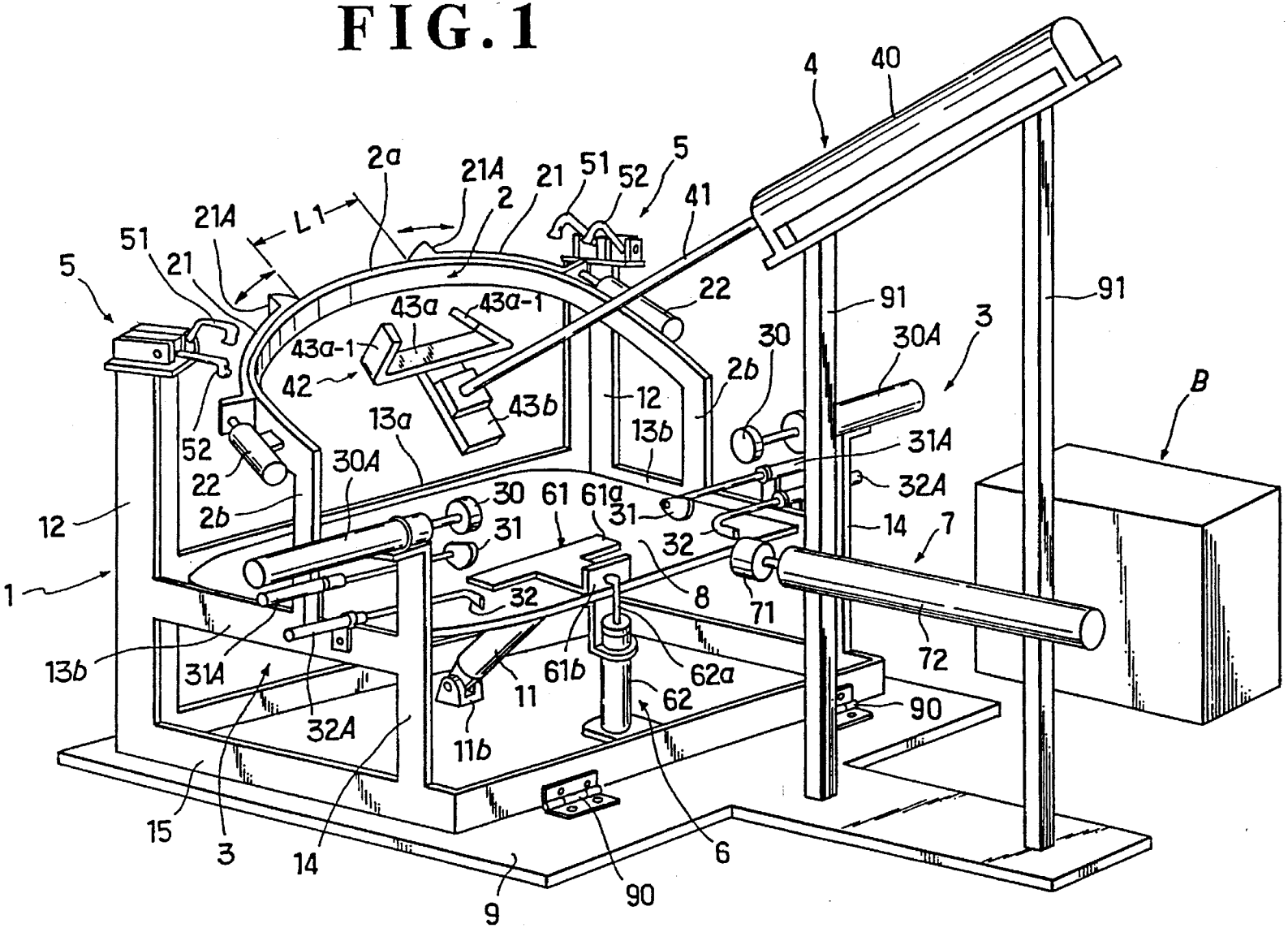
FIG. 1 is a schematic perspective view of a device in accordance with the present invention.

As shown in FIG. 1, the illustrated device basically comprises a base plate (9), a movable frame assembly (1) hingedly connected to the base plate (9), a trim cover assembly securement mechanical element (2) integrally erected from the movable frame assembly (1), a table member (8) fixed within the movable frame assembly (1), a pair of mutually-opposed inwardly pressing mechanical elements (3)(3), a pair of mutually-opposed outwardly stretching mechanical elements (31, 31A, 32, 32A), a pair of cramping elements (5)(5), a downwardly pressing element (4), and lifting element (6).

Essentially, arranged upon the base plate (9) are the movable frame assembly (1) and downwardly pressing element (4).

Figure 5:
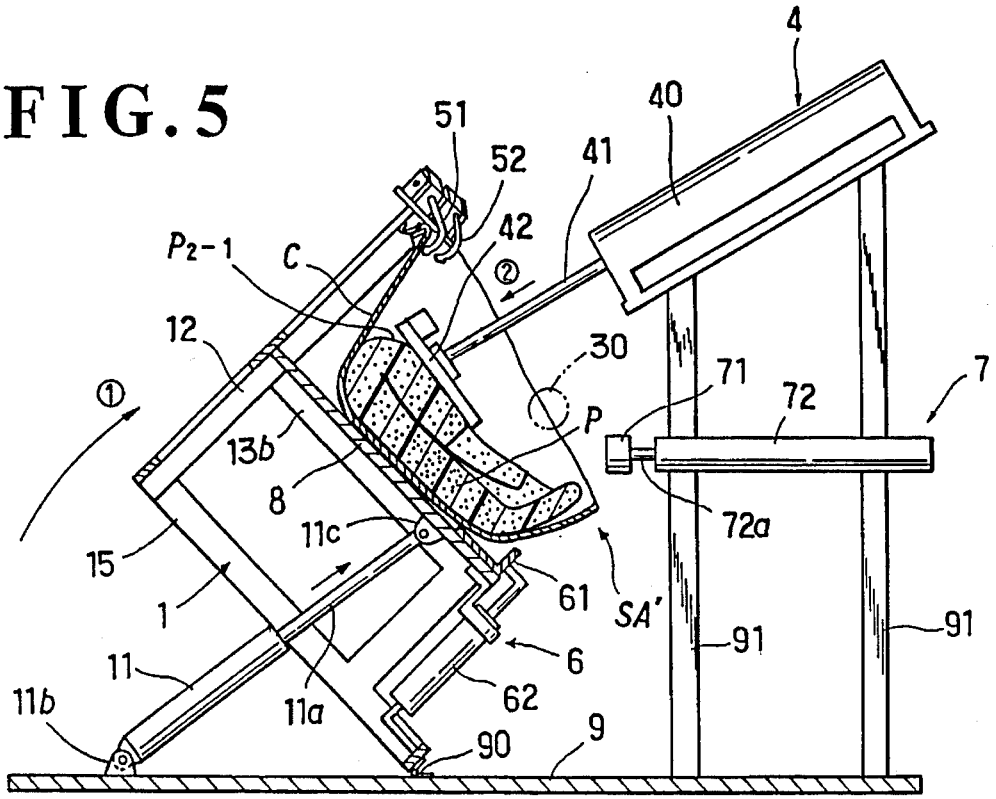
FIG. 5 is a sectional view of the device, showing a cushion member to be pressed by the device.

The movable frame assembly (1) has a lower rectangular frame section (15) whose one side is connected via two hinge members (90)(90) to the base plate (9) in the vicinity of the downwardly pressing element (4), as shown in FIG. 1. Also, the movable frame assembly (1) is connected to a cylinder (11) via the table member (8). Hence, the movable frame assembly (1) may be rotated by operating the cylinder (11) relative to the hinge members (90)(90) in a direction towards and away from the downwardly pressing element (4) as shown in FIG. 5. The cylinder (11) is best shown in FIG. 5 as being extended between the base plate (9) and table member (8) in such a manner as to be inclined upwardly towards the downwardly pressing element (4). The cylinder (11) has a piston rod (11*a*) (shown in FIG. 5), whose upper end is pivotally connected to the reverse side of table member (8) by a pivot member (11*c*), and further, the lower end of the same cylinder (11) is connected pivotally to the base plate (9) by a pivot member (11*b*). With this structure, the movable frame assembly (1) may be smoothly displaced to a position where it is downwardly inclined relative to the hinges (90)(90), to establish a mutually faced or generally parallel relation between the table member (8) and the pressing plate (42) of downwardly pressing element (4).

As shown in FIG. 1, the construction of the movable frame assembly (1) is such that a pair of first vertical corner frame sections (12)(12) and a pair of second vertical corner frame sections (14)(14) erect vertically and continuously from the respective four corners of the lower rectangular frame section (15), and that a horizontal frame section (13*a*) is extended between the two first vertical corner frame sections (12)(12) in an integral manner, and a pair of other horizontal frame sections (13*b*)(13*b*) are respectively extended, in an integral manner, between a left-side pair of the first and second corner frame sections (12)(14) and another right-side pair of the first and second corner frame sections (12)(14). The table member (8) is fixed at those three horizontal frame sections (13*a*)(13*b*)(13*b*).

Figure 2:
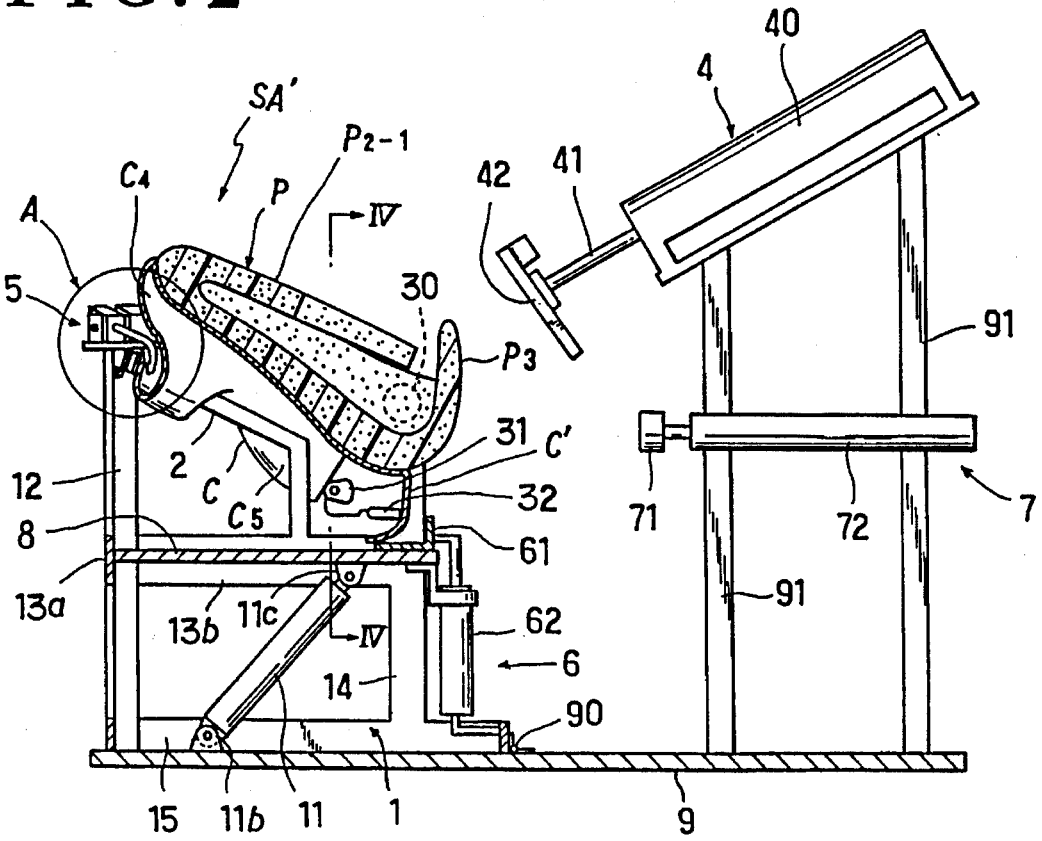
FIG. 2 is a sectional view of the device.

As seen in FIG. 2, the trim cover assembly securement mechanical element (2) is so designed to receive and secure thereon the upper overhang section (C4) and adjacent parts of lateral overhang sections (C5, C5') of trim cover assembly (C) associated with the foregoing incomplete sub-assembly (SA'). For that purpose, the element (2) comprises an upwardly inclined arcuate supporting frame (2*a*) which forms a main portion for receiving and supporting those overhang sections of trim cover assembly (C), a pair of vertical support frames (2*b*)(2*b*) which continue downwardly from the respective both ends of the arcuate supporting frame (2*a*), a pair of slidable arcuate securing arms (21)(21), and a pair of cylinders (22)(22) for causing the respective two securing arms (21) to be moved slidingly along the outward surface of arcuate supporting frame (2*a*). The two vertical support frames (2*b*)(2*b*) are integrally formed with both horizontal frame sections (13*b*)(13*b*), respectively, in a manner erecting vertically therefrom and terminating in two upper ends from which the arcuate supporting frame (2*a*) extends upwardly at a certain angle of inclination. The two arcuate securing arms (21)(21) are each formed with an arrowhead-like projected end (21A) having a sloped outer surface (see FIGS. 6 and 7). Normally, the two securing arms (21)(21) are spaced apart from each other, such as to set their respective two arrowhead-like ends (21A)(21A) away from each other a distance (L1) generally equal to the length (L) of the anchor member (F) fixed at the end of the aforesaid upper overhang section (C4), as can be seen from FIGS. 1 and 9. This is because the anchor member (F) is to be retained between the two arcuate securing arms (21)(21), as will be explained later.

It is noted that a space area defined inwardly of the arcuate supporting frame (2*a*) should be generally equal to or slightly greater than the width of upper half portion of the cushion member (P), with a view to allowing the cushion member (P) to be passed through such inward space area in the arcuate supporting frame (2*a*), which will also be explained in details later.

The two cramping elements (5)(5) are each fixed on the respective upper ends of the two first vertical corner frame sections (12)(12) which erect higher than the foregoing arcuate supporting frame (2*a*). Each of the cramping elements (5)(5) is operable to cause its two cramp pieces (51)(52) to be moved for contact with the inward surface of the arcuate supporting frame (2*a*), thereby cramping or retaining thereto the right- and left-side corner portions (LC)(RC) defined between the upper and lateral overhang sections (C4)(C5)(C5').

Figure 9:
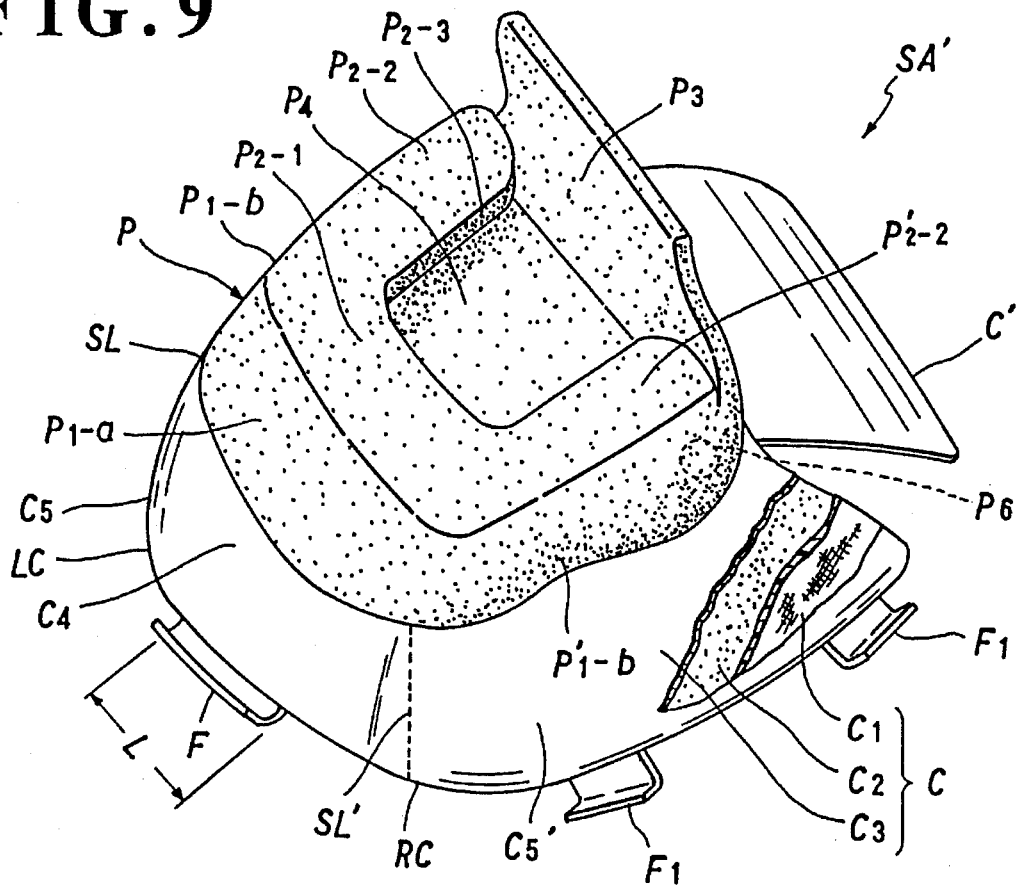
FIG. 9 is a partly broken perspective view of an incomplete seat sub-assembly.

As shown in FIG. 1, with additional reference to FIG. 9, the two inwardly pressing mechanical elements (3)(3) are provided on the respective upper ends of the two second vertical corner frame sections (14)(14) which erects at a lower level than the height of the arcuate supporting frame (2*a*). Such elements (3)(3) are operable to press both lateral lower wall portions (at (P6) in FIG. 9) of cushion member (P) in an inward direction toward each other. For that operation purpose, each of the elements (3)(3) is comprised of a cylinder (30A) and a circular pressing member (30) fixed to the piston rod of the cylinder (30A), such that both circular pressing members (30) are caused to press against both lateral lower wall portions (P6) of cushion member (P) by operation of the respective cylinders (30A).

The two outwardly stretching mechanical elements (31, 31A)(32,32A) are each fixed on the respective two horizontal frame sections (13*b*)(13*b*), such as to be disposed between the vertical support frames (2*b*) of arcuate supporting frame (2*a*) and the second corner frame section (14). Each of those two elements comprises a pair of mutually-opposed stretcher plates (31)(31) and a pair of mutually-opposed L-shaped stretcher rods (32)(32), such that the stretcher plates (31)(31) are each connected to the respective two cylinders (31A)(31A), while the stretcher rods (32)(32) are each connected to the respective two cylinders (32A)(32A). As viewed from FIG. 1, a right-side pair of the stretcher plate and rod (31)(32) and a left-side pair of the stretcher plate and rod (31)(32) may be moved in an outward direction away from one another by operation of the respective cylinders (31A)(32A), for the purpose of stretching the two lateral overhang sections (C5)(C5') outwardly away from each other as can be seen from FIG. 4.

As seen in FIG. 1, the downwardly pressing element (4) comprises a cylinder (4) and a generally T-shaped pressing plate (42) fixed to the piston rod (41) of the cylinder (40). As shown, the T-shaped pressing plate (42) comprises a horizontal section (43*a*) and a vertical section (43*b*), the horizontal section (43*a*) being formed with a pair of inwardly bent end portions (43*a*-1)(43*a*-1). Such pressing plate (42) is fixed at its vertical section (43*b*) to the piston rod (41) of cylinder (40) at a generally right angle relative thereto. The pressing plate (42) may be moved by operating the cylinder (40) towards the arcuate supporting frame (2*a*), whereby, as will be explained later, the upper reverse wall part (P2-1) of cushion member (P) in the incomplete seat sub-assembly (SA') will be pressed by the pressing plate (42) as shown in FIG. 5. In this regard, the two inwardly bent end portions (43*a*-1) of pressing plate (42) serve to prevent the pressing plate (42) from being caught by the surrounding overhang sections (C4)(C5)(C5') of trim cover assembly (C) when the pressing plate (42) is raised from the pressing position shown in FIG. 5.

With reference to FIG. 1, the lifting element (6) is provided between the table member (8) and the forward side of lower rectangular frame section (15) of movable frame assembly (1). The lifting element (6) comprises a cylinder (62) and a generally T-shaped lifting plate (61) fixed to the piston rod (62*a*) of the cylinder (62). The cylinder (62) is disposed between the table member (8) and lower rectangular frame section (15), such that the upper end part of cylinder (62) is fixed to the table member (8), while the lower end part of the same is fixed to that frame section (15). The lifting plate (61) is formed with a generally T-shaped plate body (61*a*) and an upturned end (61*b*). The upturned end (61*b*) is fixed to the cylinder piston rod (62*a*). As shown in FIG. 1, the lifting plate (61) normally rests upon the forward end area of table member (8), but may be moved upwardly by operation of the cylinder (62) for the purpose of lifting the backward portion of a resulting seat sub-assembly (SA) to thereby place the seat sub-assembly in a properly inclined state for facilitating the ease with which it is discharged to the outside of the movable frame assembly (1).

Figure 8:
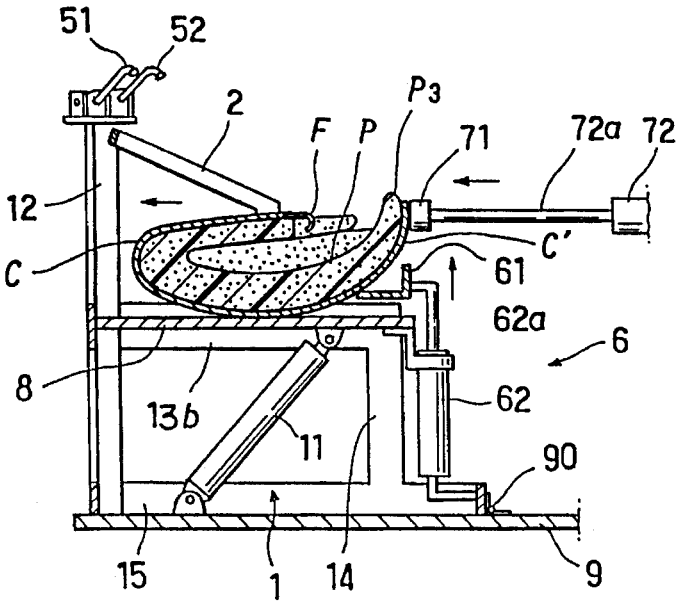
FIG. 8 is a sectional view of the device, showing a resulting seat sub-assembly to be discharged therefrom.

Designation (7) denotes a discharging element for causing the resulting seat sub-assembly (SA) to be discharged from the table member (8), as indicated in FIG. 8. The discharging element (7) comprises a cylinder (72) which is fixed to the two pillars (91)(91) at a location below the cylinder (40) of downwardly pressing element (4), and a circular pushing member (71) fixed to the piston rod (72*a*) of the cylinder (72) (see FIG. 5). Operating the cylinder (72) causes the pushing member (71) to be moved in a direction rearwardly of the movable frame assembly (1) to push the resulting seat sub-assembly (SA) and discharge the same outwardly from the table member (8), as shown in FIG. 8.

Designation (B) (shown in FIG. 1), denotes a control operation box which, although not shown, includes a computer, several associated electric circuits, relays and switches required for operating the above-described elements (1, 2, 3 . . . ) according to a predetermined sequence of operations programmed in the computer. A worker can simply make a proper switch operation on the box (B) to effect the programmed automated operations of those elements so as to produce the resulting seat sub-assembly (SA). But, this is not the main inventive subject matter, and thus further detailed description is omitted thereabout.

It is noted that the aforementioned anchor member (F) fixed at the end of upper overhang section (C4) of trim cover assembly (C) should preferably be formed from an elastic synthetic resin material (e.g. polypropylene), such as to be resiliently bendable to a certain degree.

Now, a description will be made of operation of the above-described device, with reference to FIGS. 2 to 10.

First, as shown in FIG. 2, a worker prepares the incomplete seat sub-assembly (SA') which comprises the foam cushion member (P) and the turned-over trim cover assembly (C) fixed thereto, with the four reversely turned overhang sections (C4)(C5)(C5')(C') extending from the frontal surface side of the cushion member (P) as mentioned previously in the prior art description. Then, the worker turns upside down such incomplete seat sub-assembly (SA'), as shown in FIG. 9, so that the reverse side of cushion member (P) appears upwardly, with those trim cover assembly overhang sections (C4)(C5)(C5')(C') depending downwardly therefrom.

Figure 3:
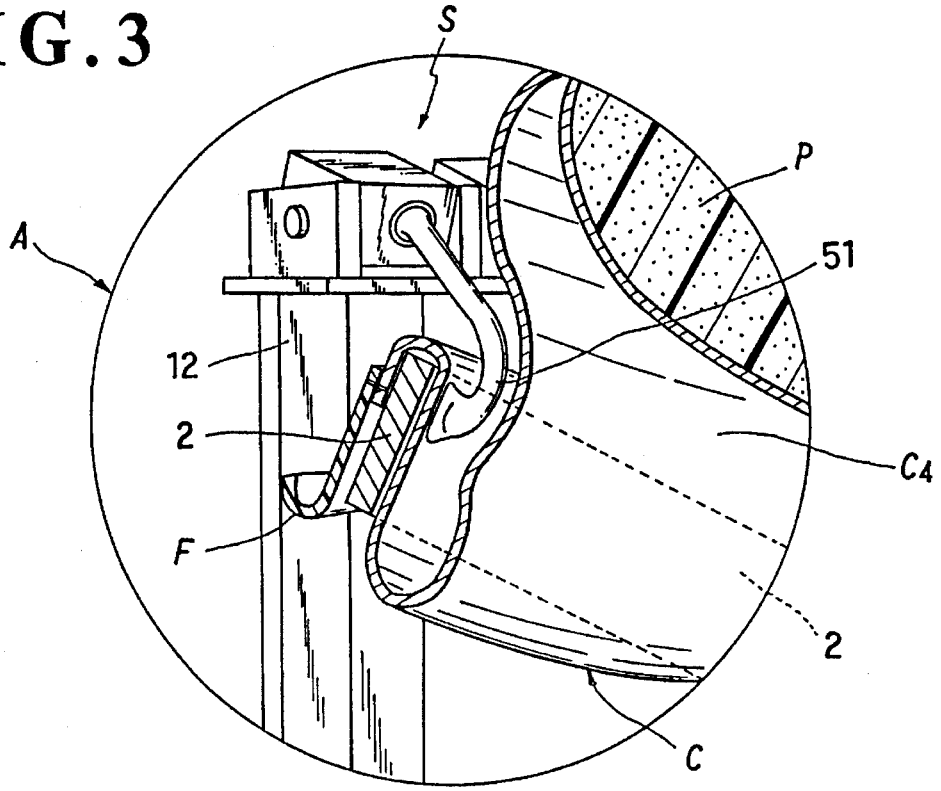
FIG. 3 is a partially enlarged view taken from the circle "A" in FIG. 2.
Figure 6:
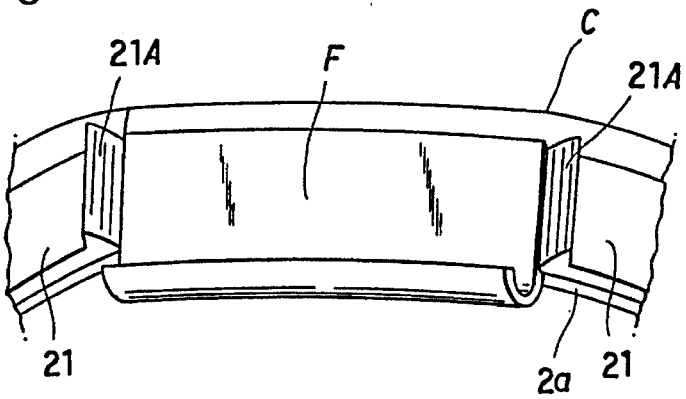
FIG. 6 is a diagram showing an anchor member to be retained between a pair of arcuate securing arms.
Figure 7:
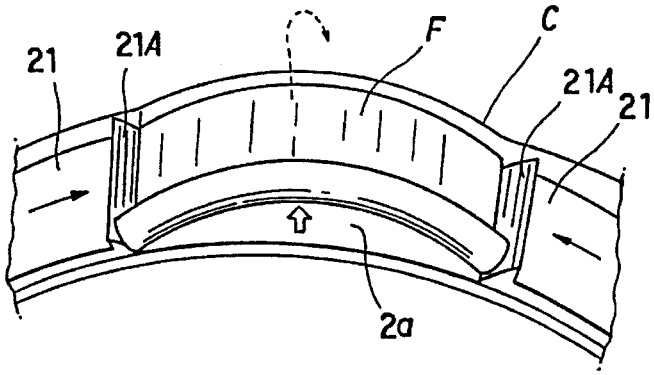
FIG. 7 is a diagram showing the anchor member to be ejected from the two arcuate securing arms.

Next, the worker places the incomplete seat sub-assembly (SA') on the arcuate supporting frame (2*a*), by turning up the terminal end area of the upper overhang section (C4) and folding down the same over the arcuate supporting frame (2*a*) as shown in FIG. 3. Then, the anchor member (F) is securely retained between the two arcuate securing arms (21)(21) as shown in FIG. 6, with a slight retaining force, by operation of the two associated cylinders (22)(22). Also, the two corners (LC)(LC') of trim cover assembly overhang sections (C4, C5, C5') are temporarily secured by the two cramping elements (5)(5), respectively, to the inner surface of the arcuate supporting frame (2*a*) as best seen in FIG. 3.

At this stage, it should be noted that all the three trim cover assembly overhang sections (C4)(C5)(C5') still stand on and upright from the arcuate supporting frame (2*a*), due to their three-dimensional sewn structure, hence supporting the cushion member (P) upwardly above the arcuate supporting frame (2*a*) as can be seen from FIG. 2.

Figure 4:
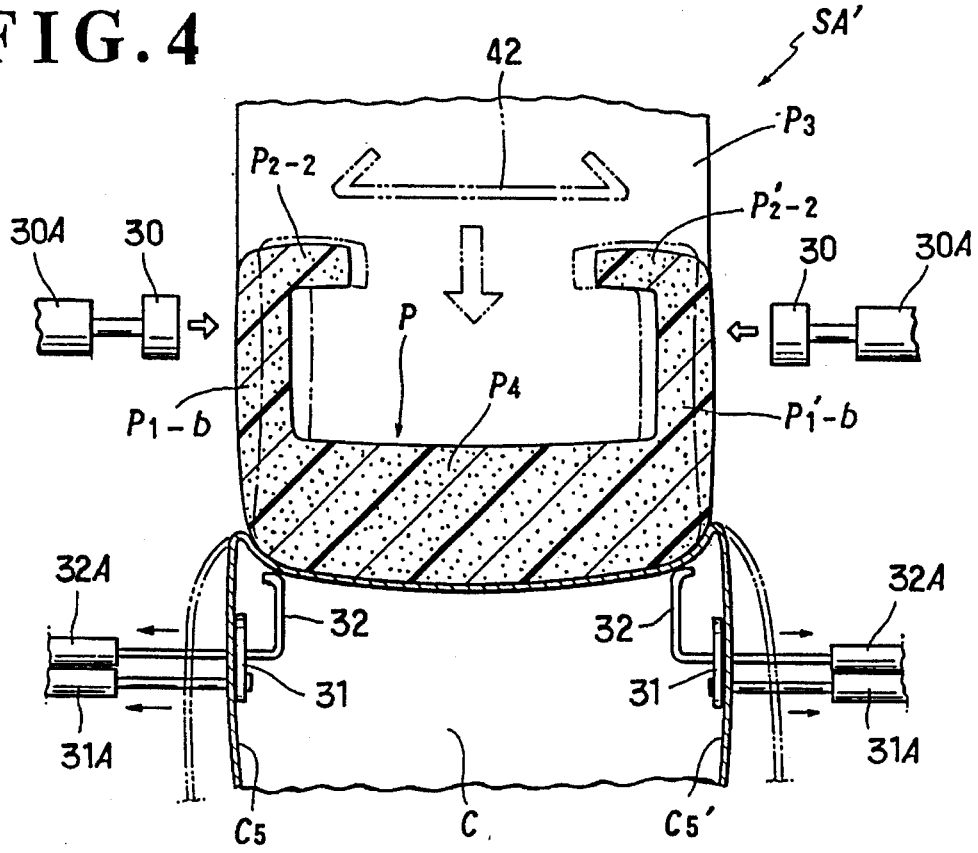
FIG. 4 is a sectional view taken along the line IV—IV in FIG. 2.

Then, the lower areas of both lateral overhang sections (C5)(C5') are respectively set at the two outwardly stretching elements (31, 31A, 32, 32A), as shown in FIG. 4, such that the right paired and left paired stretcher plates and rods (31)(32) are located inwardly of the respective right and left lateral overhang sections (C5)(C5'). By operating the associated cylinders (31A)(32A), both right paired and left paired stretcher plates and rods (31)(32) are moved in a direction away from one another, as indicated by the small arrows in FIG. 4, to thereby stretch outwardly both right and left overhang sections (C5)(C5') to their symmetrically extended points indicated by the two-dot chain lines. As can be seen from FIG. 2, the stretcher plate (31) acts to mainly stretch the whole lateral overhang section (C5, or C5'), whereas the L-shaped stretcher rod (32) acts to neatly stretch the the lower end area of lateral overhang section (C5, or C5') adjoining the lower overhang section (C'). At this point, it is appreciated that the two upper right and left corners (RC)(LC) of upper overhang sections (C4)(C5)(C5') are stretched outwardly by the cramping elements (5)(5) from the corresponding upper peripheral wall portions of cushion member (C), while on the other hand, the two lower right and left corners of lower overhang sections (C5)(C5')(C') are stretched outwardly by the stretcher plates and rods (31)(32) from the corresponding lower peripheral wall portions of cushion member (C). Thus, all the four trim cover assembly overhang sections (C4, C5, C5', C') are now outwardly stretched from the cushion member (P).

In this connection, the free extension part of the lower overhang section (C') should be bent inwardly of the seat sub-assembly (SA') as shown in FIG. 2 so that the adjoining area between the lateral overhang section (C5 or C5') and lower overhang section (C') may be neatly stretched outwardly by the foregoing L-shaped stretch rod (31).

At the same time, as indicated by the large arrows in FIG. 4, the right and left pressing members (30)(30) of the inwardly pressing elements (3) are caused to move inwardly toward each other by operation of the associated cylinders (30A)(30A), to thereby press both right and left lateral wall portions (P1-b)(P1'-b) in the inward direction to their symmetrically pressed points indicated by the two-dot chain lines in FIG. 4. In this way, the incomplete seat sub-assembly (SA') is securely retained at its four corner points, temporarily, and located at a given position for a next processing step.

Now that the cushion member (C) is rendered smaller in width and compressed inwardly away from the trim cover assembly lateral overhang sections (C5)(C5'), all the overhang sections (C4)(C5)(C5')(C') may be easily turned over to cover the whole body of cushion member (C) by a subsequent downwardly pressing process to be set forth below.

Next, as indicated by the arrow (1) in FIG. 5, the movable frame assembly (1), on which the incomplete set sub-assembly (SA') has been secured as described above, is rotated relative to the pivot point at (90) in a direction towards the downwardly pressing element by operating the cylinder (11), and then stopped at a given downwardly inclined position, as shown. Thereafter, with the downwardly pressing element cylinder (40) operated, the pressing plate (42) is moved towards and pressed against the upper reverse wall part (P2-1), as indicated by the second arrow (2)

in FIG. 5. As a result, the cushion member (P) is forcibly pressed and displaced downwardly from the above-stated temporarily secured position where it is pressingly secured by the two pressing member (30)(30), while simultaneously, all the turned-over trim cover assembly overhang sections (C4)(C5)(C5')(C') are again turned reversely, as the cushion member (P) passes through the inward space area of the arcuate supporting frame (2*a*) down to the table member (8), whereupon the inwardly directed surface cover layers (C1) of the overhang sections (C4)(C5)(C5') is now exposed outwardly, while the outwardly exposed back cloth layer (C3) now faces toward each other inside the overhang sections (C4)(C5)(C5')(C'), and therefore, the normal state of all those overhang sections are now ready to cover the corresponding wall portions (P2-1)(P2-2)(P2'-2)(P3) of cushion member (P).

Then, the downwardly pressing plate (42) is moved from the pressing point shown in FIG. 5 back to the inoperative home position shown in FIG. 2, by operation of the cylinder (40), and the two inwardly pressing plates (30)(30) are moved outwardly from the pressing points indicated by the two-dot chain lines in FIG. 4, back to their respective home positions shown in FIG. 2. Also, the two securing arms (21)(21) are moved towards each other by operation of the associated cylinders (22)(22) to press both ends of the anchor member (F), so that the anchor member (F) is resiliently curved upwardly as indicated by the arrow in FIG. 7 and thrown out or ejected automatically, due to its elastic recovery force, from the outer surface of arcuate supporting frame (2*a*), as indicated by the phantom arrow. In this respect, both ends of anchor member (F) are easily slipped on the respective sloped surfaces of securing arm projected ends (21A)(21A), which thus facilitates such ejection of anchor member (F).

With the cramp pieces (51)(52) being all released by operation of the cramping elements (5) from the cramped state as can be seen in FIG. 8, all the trim cover assembly overhang sections (C4)(C5)(C5')(C') are automatically folded, by their remaining turning-over forces, onto the respective reverse wall portions of cushion member (P), whereby there is obtained the resulting seat sub-assembly (SA) as shown in FIG. 10.

At a final stage, as understandable in FIG. 8, the lifting plate (61) is raised by operation of the associated cylinder (62) to lift up the backward end of resulting seat sub-assembly (SA), and then, the discharging element cylinder (72) is operated to extend the pushing member (71) towards that backward end of seat sub-assembly (SA). Thus, the seat sub-assembly (SA) is pushed and moved on the table member (8) in the direction backwardly of the movable frame assembly (1), and discharged outside therefrom. But, in this respect, the discharging element (7) may not be operated and a worker may take out the resulting seat sub-assembly (SA) with his or her hands from the table member (8).

From the descriptions above, in accordance with the present invention, the trim cover assembly overhang sections (C4)(C5)(C5')(C') are easily turned over to cover the reverse side of cushion member (C), without requiring a great force on the worker's part. Thus, a worker has only to simply place the incomplete seat sub-assembly (SA') upon the present device, setting the anchor member (F) between the two arcuate securing arms (21)(21), all subsequent necessary actions are carried out by the device through automated control processes, so as to transform the incomplete seat sub-assembly (SA') into the resulting one (SA) with all trim cover assembly overhang sections turned over to cover the reverse side of cushion member.

While having the present invention thus far, it should be understood that the invention is not limited to the illustrated embodiment, but other various modifications, replacements and additions may be structurally applied thereto without departing from the scopes of the appended claims.

What is claimed is:

1. A device for affixing a trim cover assembly to a cushion member, in which the cushion member is preformed into a predetermined shape of an automotive seat and the trim cover assembly is preformed into a predetermined three-dimensional body generally conforming to a whole body of said cushion member, said trim cover assembly being turned over and fixed at its central reverse area to a corresponding central surface area of said cushion member, thereby providing an incomplete seat sub-assembly with said trim cover assembly extending an overhang section around said cushion member, said device comprising:

a frame means including a support frame having a configuration generally equal in shape to a part of outer peripheral sides of said cushion member associated with said incomplete seat sub-assembly, on which support frame, said incomplete seat sub-assembly is to be turned upside down and placed;

a cramp means for securing an end of said overhang section of said trim cover assembly to an inward side of said support frame means; and a pressing means for applying a downward pressure towards said support frame;

wherein said incomplete seat sub-assembly is turned upside down and placed on said support frame, with a reverse side of said cushion member exposed upwardly, wherein said overhang section of trim cover assembly is secured by said cramp means to said support frame, and wherein operation of said pressing means applies the downward pressure against said reverse side of said cushion member, thereby causing said cushion member to be moved downwardly through said support frame, whereby said overhang section of said trim cover assembly is turned over relative to said support frame and cover the whole body of said cushion member by releasing a securing action of said cramp means, so as to transform said incomplete seat sub-assembly into a resulting seat sub-assembly with the whole body of said cushion member covered with said trim cover assembly.

2. The device according to claim 1, wherein said frame means includes an inwardly pressing means for pressing both lateral sides of said cushion member of said incomplete seat sub-assembly in a direction inwardly of said frame means and an outwardly stretching means for stretching said overhang section of said trim cover assembly in a direction outwardly of said frame means, so as to permit said cushion member to be easily moved downwardly through said support frame by operation of said pressing means, thereby facilitating an ease with which said trim cover assembly overhang section is turned over to cover said cushion member.

3. The device according to claim 1, wherein said frame means comprises a movable frame assembly and a base means, wherein said movable frame assembly is so hingedly connected to said base means as to be inclinable towards said pressing means, and wherein said support frame is formed on said movable frame assembly, whereby said cushion member of said incomplete seat sub-assembly secured on said support frame may be positioned at a point facing towards said pressing means.

4. The device according to claim 2, wherein said said inwardly pressing means comprises a pair of mutually-opposed pressing members with their respective actuators, and wherein said outwardly stretching means comprises a pair of mutually opposed stretcher plates with their respective actuators and a pair of mutually opposed L-shaped stretcher rods with their respective actuators.

5. The device according to claim 4, wherein all said actuators are cylinders fixed on said frame means.

6. The device according to claim 1, wherein said frame means includes a table member disposed below said support arm, on which table member, said resulting seat sub-assembly is placed.

7. The device according to claim 6, wherein a lifting means is provided at said table means, and wherein said resulting seat sub-assembly is raised by said lifting means form said table means.

8. The device according to claim 1, wherein said cramp means comprises a pair of cramping elements mounted on said frame means in vicinity of said support frame, wherein each of said two cramping elements includes two cramp pieces, thus providing one paired cramp pieces and another paired cramp pieces, and wherein two corners of an upper part of said trim cover assembly overhang section may be secured respectively by said one and another paired cramp pieces.

9. The device according to claim 1, wherein said trim cover assembly overhang section is provided at the end thereof with an anchor member made of an elastic synthetic resin material, wherein said support frame includes a pair of securing means for securing said anchor member, said pair of securing means being slidable along an outer surface of said support frame in a direction toward and away from each other, and wherein said pair of securing means are normally spaced apart from each other a distance generally equal to a length of said anchor member, allowing securement of said anchor member between the two securing means, and further allowing said anchor member to be pressed by said two securing means and resiliently ejected from said support frame.

10. The device according to claim 1, wherein said pressing means comprises a cylinder which is disposed above and adjacent to said frame means and a pressing plate which is so fixed to said cylinder as to be directed towards said support frame.

11. The device according to claim 10, wherein said pressing plate is formed in a generally "T" shape, comprising a horizontal portion and vertical portion extending therefrom, and wherein both end parts of said horizontal portion are upturned and inwardly bent toward each other.

12. The device according to claim 6, wherein a discharging means is provided adjacent to said table member, and wherein said resulting seat sub-assembly may be pushed and discharged outwardly from said table member by operation of said discharging means.

* * * * *